United States Patent [19]

Smith et al.

[11] 4,380,330

[45] Apr. 19, 1983

[54] CATCHERLESS CLOTH SPREADING MACHINE

[75] Inventors: Hoyt L. Smith, Nashville, Tenn.; Cecil S. Frederick, deceased, late of Murfreesboro, Tenn.; by Wallace Frederick, administrator, Readyville, Tenn.

[73] Assignee: Cutters Exchange, Inc., Nashville, Tenn.

[21] Appl. No.: 189,594

[22] Filed: Sep. 22, 1980

Related U.S. Application Data

[63] Continuation-in-part of Ser. No. 45,181, Jun. 4, 1979, abandoned.

[51] Int. Cl.[3] ..... B65H 29/46

[52] U.S. Cl. ..... 270/31

[58] Field of Search ..... 270/30-31; 83/925 CC; 68/177-178; 100/80; 8/152

[56] References Cited

U.S. PATENT DOCUMENTS

| | | | |
|---|---|---|---|
| Re. 27,538 | 12/1972 | Martin et al. | 270/30 X |
| 1,718,743 | 6/1929 | Korndorfer | 270/30 X |
| 3,094,319 | 6/1963 | Deichmann | 270/31 |
| 3,672,662 | 6/1972 | Grimm | 270/31 |
| 3,778,050 | 12/1973 | Grimm | 270/31 |
| 3,941,366 | 3/1976 | Feld | 270/31 |
| 3,941,367 | 3/1976 | Stumpf | 270/31 |
| 4,262,893 | 4/1981 | Sgroi | 270/31 |

*Primary Examiner*—A. J. Heinz
*Attorney, Agent, or Firm*—Harrington A. Lackey

[57] ABSTRACT

A cloth spreading machine for accurately spreading layers of cloth upon a cloth supporting surface without a catcher mechanism, including a longitudinally reciprocably movable spreader frame having a vertically movable spreader element, a motor for elevating the spreader element and a sensor adapted to detect an increase in the height of the cloth layers and coupled to the elevator motor for continually maintaining a substantially uniform height between the spreader element and the top layer of cloth within close tolerances. A cutter mechanism mounted on the spreader element is operative to cut the cloth when the spreader frame is in a stationary position spaced longitudinally a short distance from the end of the traverse of the spreader frame so that when the cloth is cut, it will fall free upon the next lower layer so that its cut end will lie substantially in a vertical plane containing all of the cut ends of the spread layers. The cloth spreading machine is also provided with a pinch roller device for maintaining uniform tension in the cloth fed to the spreader element; and an expansible flexible wind curtain is mounted behind the substantially vertical path of the cloth web on the spreader frame and connected to the vertically movable spreader element to prevent the wind produced by the movement of the spreader frame from creating slack in the vertically depending portion of the cloth web on the spreader frame.

5 Claims, 12 Drawing Figures

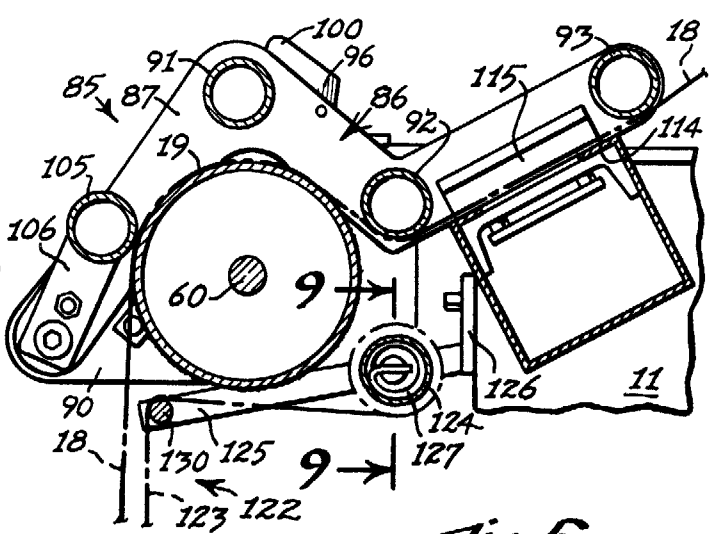
Fig. 5
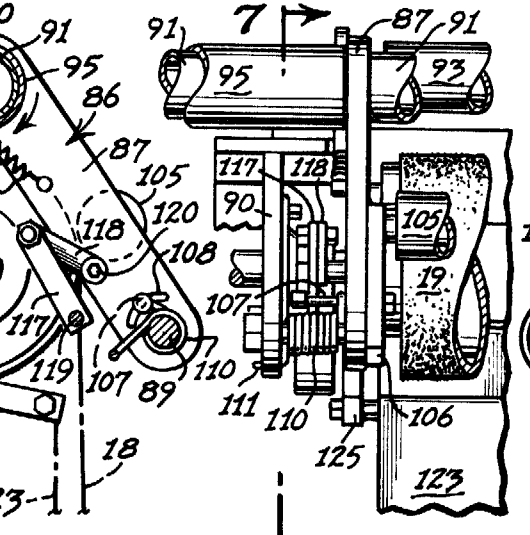
Fig. 6
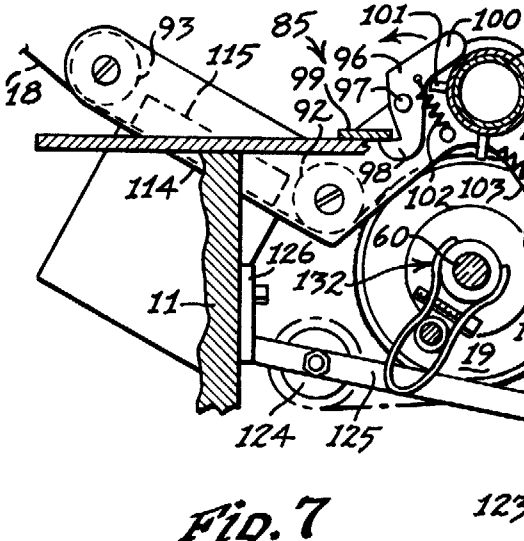
Fig. 7
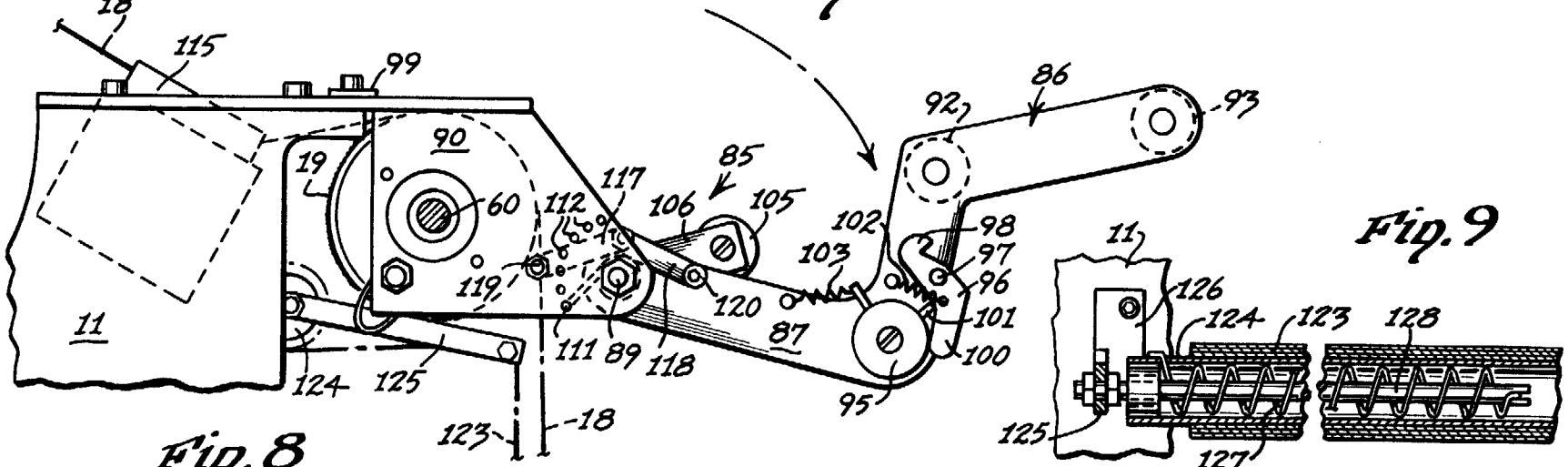
Fig. 8
Fig. 9

CATCHERLESS CLOTH SPREADING MACHINE

CROSS-REFERENCE TO RELATED APPLICATION

This application is a continuation-in-part of application Ser. No. 45,181, filed June 4, 1979, of Hoyt L. Smith and Cecil S. Frederick for SPREADER ELEMENT HEIGHT REGULATING APPARATUS FOR CLOTH SPREADING MACHINE, now abandoned.

BACKGROUND OF THE INVENTION

This invention relates to a cloth spreading machine, and more particularly to a cloth spreading machine which will accurately spread layers of cloth without a catcher mechanism, in a face-to-face mode, or a face-up or face-down mode.

Heretofore, in cloth spreading machines for reciprocably spreading layers of cloth longitudinally upon a cloth supporting surface such as a cutter table, the ends of the spread layers have been mainained in substantially vertical alignment by various types of catcher mechanisms, which cooperate with the spreader elements on the machine at the end of each spreading traverse for clamping the ends of the cloth upon the cutting table.

One example of such a cloth spreading machine for spreading the cloth face-to-face, in cooperation with a catcher mechanism is the Martin et al. U.S. Pat. No. 3,400,927.

An example of a prior cloth spreading machine for spreading cloth face-up or face-down, in which a cutting apparatus is utilized in cooperation with the spreader element in which a catcher mechanism is utilized, is the Martin et al. U.S. Pat. No. 3,503,604. The Martin et al. U.S. Pat. No. 3,503,604 incorporates a hinged spreader blade adapted to be forced down by the weight of the catcher bar in order to place the cut end of the cloth as close as possible to vertical alignment with the cut ends of the previously spread layers of cloth.

Typically, it is difficult to spread layers of cloth so that the ends of the layers are in substantial vertical alignment, when no catcher mechanism of any type is utilized. One difficulty lies in cutting the cloth transversely so that the cut end of the cloth is positioned accurately in a vertical plane containing the other cut ends of the previously spread cloth layers. Another difficulty arises in maintaining uniform tension in the cloth. A further difficulty occurs in attempting to eliminate or even minimize slack in the cloth, particularly very thin cloth, because of the wind or air movement developed against the cloth while being suspended or supported in a longitudinally movable cloth spreader frame. Moreover, the weight, density, and thickness of the cloth to be spread affect the tension and slack in the cloth as well as the degree of control required to feed, support, cut and position the cloth without a catcher mechanism.

In order to accurately position a layer of cloth upon the cutting table or previously spread layers, without a catcher mechanism, it is vitally important that the difference in elevation between the spreader element or the cutter knife and top layer of cloth be maintained substantially uniform continuously.

Heretofore, in cloth spreading machines, the height of the spreader blade or spreader element has been adjusted or elevated by various mechanical devices. One common method of elevating the cloth spreader blade is to provide a cam mechanism on the catcher at one end of the cutting table for engagement by the spreader element to elevate the spreader blade incrementally, such as illustrated in the above Martin et al. U.S. Pat. Nos. 3,400,927 and 3,503,604. Thus, as the cloth spreading machine travels the full length of the cutting table, back and forth, and spreads a sufficient number of layers of cloth, the spreader blade automatically rises a uniform increment of height. Since the compressibility and thickness of the cloth layers varies with the different types of cloth to be spread, the number of layers required to elevate the spreader blade one increment varies.

Another method of elevating the cloth spreader blades is to provide an elevator mechanism which can be raised or ratcheted upward by some type of sensor finger or feeler which is automatically forced upward by the increasing height of the cloth layers, such as disclosed in the Shapera U.S. Pat. Nos. 1,067,379; 1,131,647, or 1,531,313. This type of cloth spreader blade elevating mechanism does not produce uniform spacing between the spreader blade and the top cloth layer, because of the pliability and compressibility of the cloth layers.

Various types of tension rollers and wrap rollers have been utilized in cloth spreading machines for attempting to maintain substantially uniform tension in the cloth as it is fed through the cloth spreading machine, and for maintaining a substantial arc of wrap about a driven top feed roller in the cloth spreading machine. One example of a cloth spreading machine incorporating a pivotal wrap frame incorporating wrap rollers for being moved into engagement with a top feed roll in operative position and for swinging away from engagement to permit threading of the cloth web, in the Deichmann U.S. Pat. No. 3,094,319, issued June 18, 1963, for TURNTABLE CUTTING MACHINES. However, the Deichmann patent does not disclose any type of pinch roller for engaging the wrapped portion of the cloth web about the top feed roll. Pivotal pinch rollers for engaging cloth feed rolls per se are old, as illustrated in the Bloch U.S. Pat. No. 1,841,703 and the Sayles U.S. Pat. No. 2,478,840.

Although wind break devices have been utilized in cloth spreading machines before, nevertheless such wind break devices have been solid, fixed objects which have been positioned substantially behind the vertical path of the cloth feed web because of the necessity of the cloth spreader element to be vertically movable.

SUMMARY OF THE INVENTION

It is therefore an object of this invention to provide a method and apparatus for spreading layers of cloth reciprocably upon a cloth supporting surface in a face-to-face mode or face-up or face-down mode, accurately and without the necessity of a catcher mechanism.

Another object of this invention is to provide an apparatus for regulating the vertical spacing between the cloth spreader element on the cloth spreading machine and the top cloth layer, which is quite sensitive to the height of the cloth layers and which continuously monitors the height of the cloth layers so that the spreader element is maintained at a substantially uniform height above the top cloth layer at all times.

Another object of this invention is to provide in a cloth spreading machine a spreader element height regulating apparatus including a transverse spreader element across the front of the spreading frame mounted on an elevator carriage for vertical reciprocable movement. A reversible electrical motor is operatively connected to the elevator carriage for positively moving the carriage upward in response to a signal from a sensor adapted to detect a slight increase in the height of the top cloth layer above the cloth supporting surface.

A further object of this invention is to provide a cloth spreading machine, without a catcher mechanism, having a vertically movable transverse spreader element and a cloth cutting device mounted on the spreader element for transverse reciprocable movement along the spreader element for cutting a depending web of cloth along a transverse cutting path, in a stationary position a short distance spaced from the end of the travel of the spreading frame, such that the cut end of the web will fall free upon the spread layers to lie in a position within a vertical plane substantially containing all cut ends of the spread layer.

Another object of this invention is to provide in a cloth spreading machine having a vertically controlled spreader element and a tranversely movable cutting apparatus, control means for resuming the movement of the spreader frame and the feed of the cloth simultaneously after the cloth web carried by the spreader element has been transversely cut in a stationary position until the cut end of the depending web is adjacent the cut end of the top spread layer at the end of travel and in the vertical plane containing all the cut ends of the layers, and then for reversing the movement of the frame to resume the spreading and feeding operations.

Another object of this invention is to provide in a cloth spreading machine having a top feed roll and a pivotal wrap frame containing at least one wrap roller, a tranverse pinch roller pivotally mounted upon the wrap frame for limited independent pivotal movement relative to the pivotal movement of the wrap frame, and for engagement of the top feed roll by the pinch roller when the wrap frame is in its operative wrapping position. The pinch roller may be biased against the top feed roll to a degree dependent upon the nature of the cloth being fed.

Another object of this invention is to provide in a cloth spreading machine having a top feed roll and a pivotal wrap frame carrying at least one wrap roller, an automatic latching mechanism for latching the wrap frame in its operative wrapping position, and a manually operated latch release mechanism.

A further object of this invention is to provide a wind break device including a wind curtain of flexible sheet material having its upper end wound about a spring-driven curtain roller beneath a top feed roll, and having its lower end fixed to the vertically movable spreader element, so that the curtain lies substantially in a vertical plane spaced closely to the vertical feed path of the depending cloth web fed between the top feed roll and the spreader element.

BRIEF DESCRIPTION OF THE DRAWINGS

FIG. 5 is an enlarged fragmentary section taken along the line 5—5 of FIG. 2, with the wrap frame in its operative position;

FIG. 6 is a fragmentary, front end elevation of the proximal side portion of the wrap frame disclosed in FIG. 5;

FIG. 7 is a fragmentary section taken along the line 7—7 of FIG. 6;

FIG. 8 is an enlarged, fragmentary side elevation taken along the line 8—8 of FIG. 2, with the wrap frame disclosed in its inoperative position;

FIG. 9 is a fragmentary section taken along the line 9—9 of FIG. 5;

DESCRIPTION OF THE PREFERRED EMBODIMENTS

Figure 1:
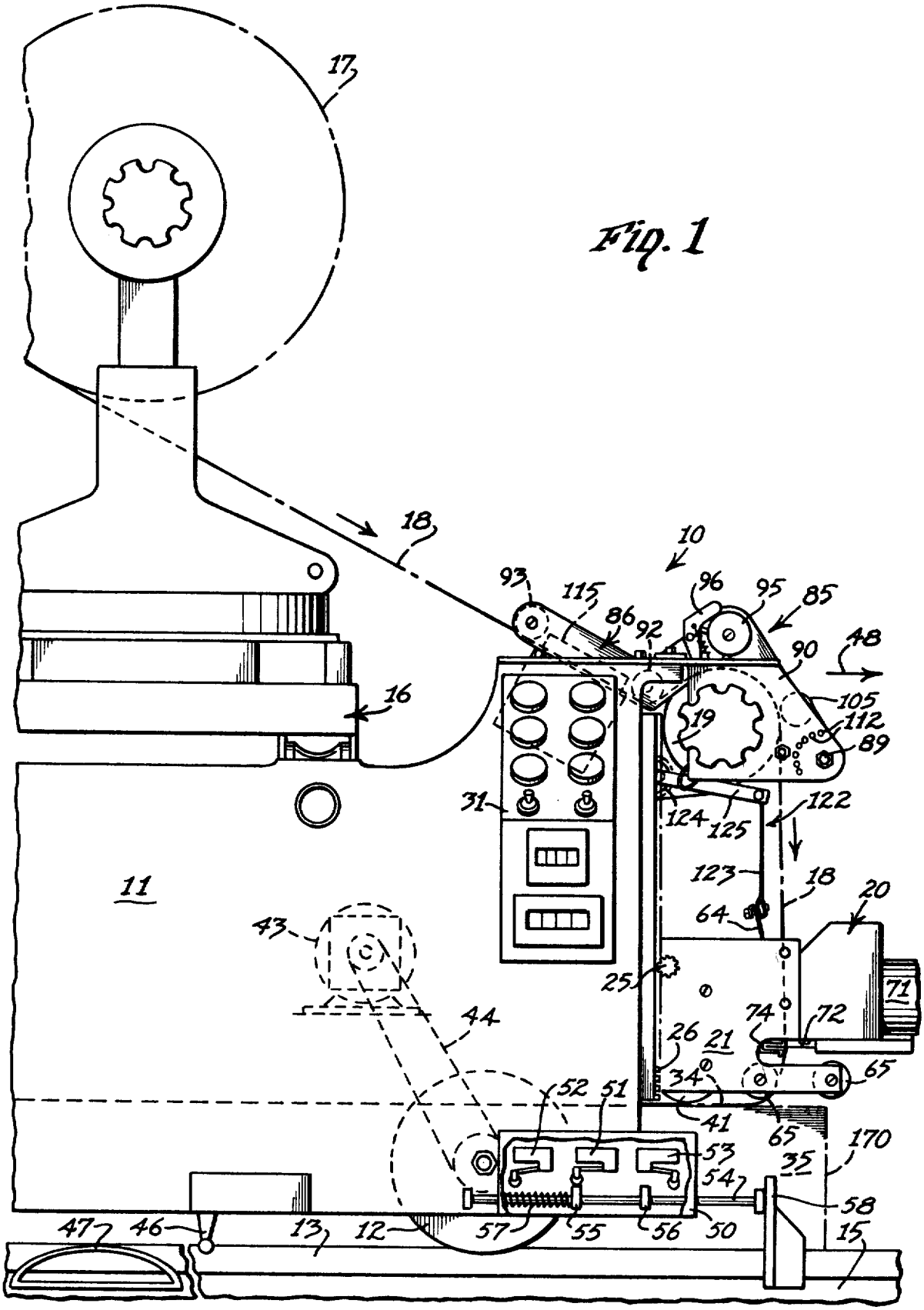
FIG. 1 is a fragmentary, side elevation of the front portion of a cloth spreading machine incorporating this invention, with portions broken away.
Figures 2, 3, 4:
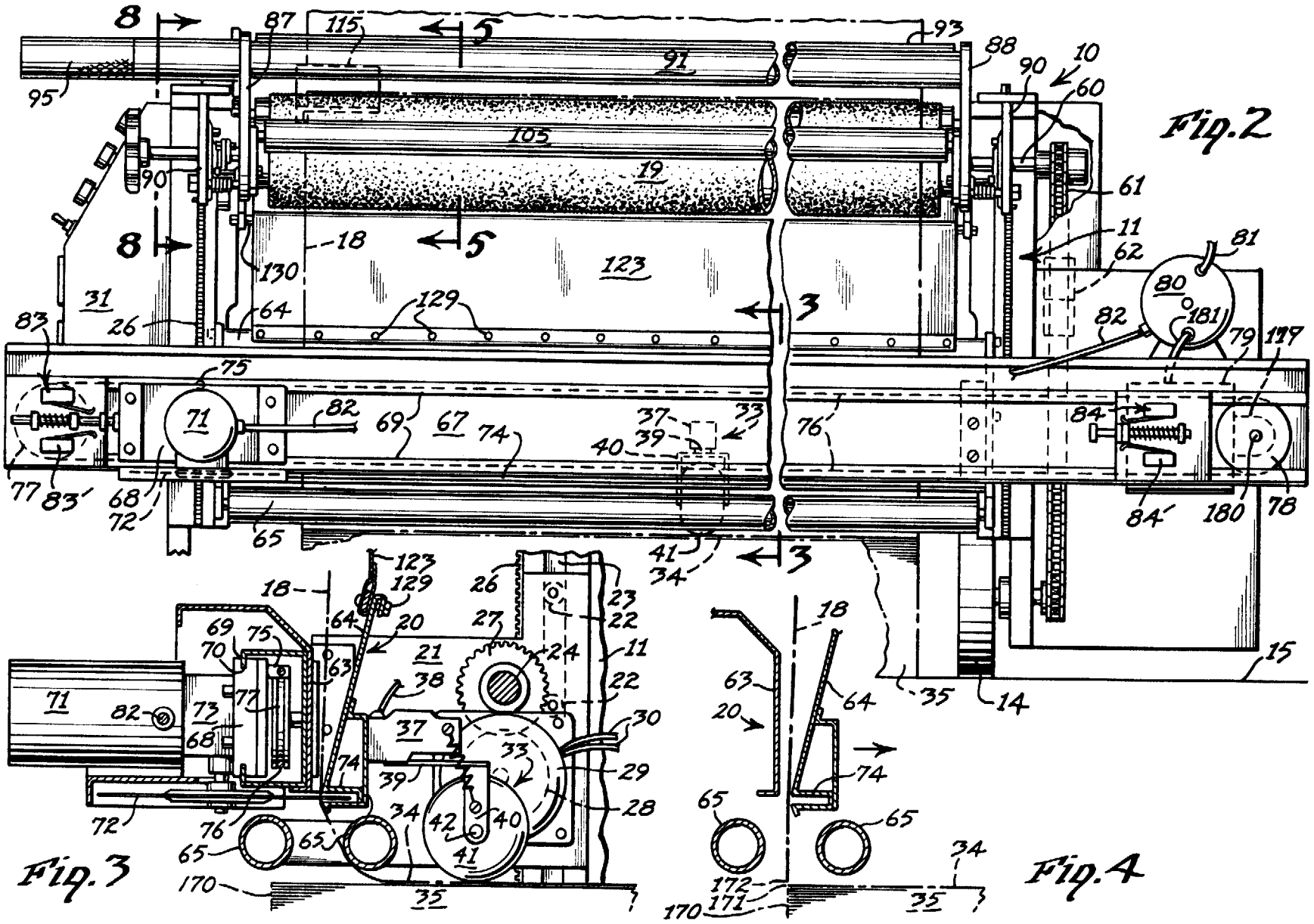
FIG. 2 is a fragmentary, front elevation of the machine disclosed in FIG. 1, with portions broken away.
FIG. 3 is an enlarged, fragmentary section taken along the line 3—3 of FIG. 2, with the spreader frame in its stationary cutting position.
FIG. 4 is a schematic side elevation of the spreader element of FIG. 3, illustrated in its terminal position at the end of a cloth spreading traverse.

Referring now to the drawings in more detail, FIGS. 1 and 2 disclose a cloth spreading machine 10 having a mobile frame 11 supported by a track wheel 12 mounted on a track or rail 13, and a remote table wheel 14 rollable upon the surface of a cloth supporting surface of cutting table 15.

Supported on the frame 11 is a transversely movable cloth supply carriage 16 supporting a cloth supply roll 17. A web of cloth 18 is fed from the supply roll 17 across the driven top cloth feed roller 19 downward through a transversely extending cloth spreader element or head 20 fixed to an elevator carriage 21.

The opposite ends of the elevator carriage 21 are provided with guide rollers 22 constrained to rolling movement in vertically elongated slotted tracks 23 mounted on opposite sides of the front end of the mobile frame 11.

Rotatably supported in bearings in the opposite ends of the transverse carriage 21 is a transverse pinion shaft 24. The ends of the shaft 24 comprise pinions 25 engaging the racks 26 on the front edges of the track 23.

The proximal end portion of the pinion shaft 24 is fixed to a driven gear 27 (FIG. 3) of substantially larger diameter than the pinion 25. The gear 27 meshes with a drive gear 28 fixed to the shaft of the electric elevator motor 29, which in turn is mounted on the elevator carriage 21. The electric motor 29 is connected by leads 30 to electrical controls within the control panel 31 in order to drive the motor 29 to raise or lower the elevator carriage 21 on the racks 26.

The sensor device 33 disclosed in FIG. 3 includes a microswitch 37 fixed upon the elevator carriage 21 and connected by an electrical cable 38 (FIG. 3) to the appropriate electrical controls (not shown) within the control panel 31 for controlling the operation of the electrical elevator motor 29. The microswitch 37 is provided with a sensitive pivotal switch arm 39, the free end of which is fixed to a yoke 40 for receiving a sensor or feeler member or wheel 41. In a preferred form of the invention, the feeler wheel 41 is preferably provided with a rim having a convex arcuate cross-section to minimize the surface contact between the feeler wheel 41 and the top cloth layer 34, and thereby minimize creasing or wrinkling of the top layer.

Although the feeler wheel 41 is shown as rotatably mounted upon the yoke 40 by means of the shaft 42, nevertheless the feeler wheel 41 does not have to rotate, nor need it be in the form of a wheel, but could be in any form adapted to touch or yield to the top surface 34. Thus, an increase in the height of the cloth layers 35 by as much as one or two cloth layer thicknesses will produce enough pressure against the feeler member 41 to move the switch arm or finger 39 sufficiently to actuate the microswitch 37, thereby energizing the motor 29 to drive upward the elevator carriage 21. As soon as the elevator carriage 21 has been elevated sufficiently to maintain a substantially uniform height between the top layer 34 and the spreader element 20, then the pressure on the feeler member 41 will be relieved, causing the switch arm 39 to drop and de-actuate the microswitch 37 to stop the electrical motor 29 and thereby stop the movement of the elevator carriage 21.

Because of the sensitivity of the microswitch 37 and its arm 39, the elevator motor 29 is normally energized for only a fraction of a second. Thus, the upward movement of the elevator carriage 21 is so slight as normally to be unnoticeable by the human eye, and may amount to only one or two web thicknesses of the cloth layers 34 and 35, for each actuation of the sensor device 33.

Moreover, the sensitivity of the response of the elevator carriage 21 to the sensor device 33 is enhanced by the substantial speed reduction effected in the transmission between the elevator motor 29 and the driven pinion 25, as well as the continuity of the driving engagement between the drive transmission elements, such as the continually intermeshing teeth of the gears 28 and 27, and the teeth of the pinion 25 and rack 26. The constant driving engagement of the transmission elements permits a continual movement of the elevator carriage 21 commensurate with the energization time of the electrical elevator motor 29, as opposed to incremental spaced movements such as encountered by certain prior art ratchet-and-pawl elevator mechanisms.

The spreader frame 11 is preferably power-driven by a motor 43 (FIG. 1) which is adapted to drive one of the wheels 12 through a transmission, such as the sprocket and chain transmission 44.

The machine 10 is normally driven through the controls in the panel 31 at high speed for rapid spreading of the cloth layers 35. As the machine frame 11 approaches the end of its spreading travel or traverse, a low-speed switch arm 46 engages and is tripped by a stationary trip member 47 fixed to the side of the cutting table 15 to slow down the motor 43 and cause the machine 10 to approach the end of its travel at a low speed. As disclosed in FIG. 1, the switch arm 46 has just passed and been tripped by the trip member 47 as the machine frame 11 moves in the forward direction of the arrow 48.

Also, as disclosed in FIG. 1, a switch box 50 is mounted on the side of the frame 11 and contains 3 longitudinally spaced trip switches or microswitches 51, 52, and 53. The switch box 50 also contains a longitudinally movable plunger rod 54 having trip lugs 55 and 56 thereon and a spring 57 for normally projecting the plunger rod forward from the switch box 50. As the machine frame 11 approaches the end of its travel, the front end of the plunger rod 54 will engage the stop member 58 fixed to the side of the cutting table 15 near the end of the travel of the frame 11. The continued forward movement of the switch box 50 will result in the plunger rod 54 relatively moving rearwardly through the switch box 50, so that the switches 51, 52, and 53 will be progressively actuated. The switches 51 and 52 will first be sequentially activated by the trip lug 55. After the plunger rod 54 is completely retracted and the machine frame 11 reverses its direction, then the plunger rod 54 will gradually be released by the force of the coil spring 57 causing the trip lug 56 to engage and actuate the switch 53.

The function of the switches 51, 52, and 53 will be described later.

The top feed roll 19 is preferably provided with a high-frictional surface for engaging or gripping the portion of the cloth web 18 which passes around it. The cloth feed roll 19 is driven synchronously with the longitudinal movement of the machine frame 11, so that cloth is fed to the cutting table at the same rate as the longitudinal travel of the machine frame 11 over the cutting table 15. The means for driving the feed roll 19 in synchronism with the frame movement may be any one of several conventional means. As disclosed in FIG. 2, the cloth feed roll shaft 60 is driven through a sprocket and chain transmission 61 from the frame wheel 14. The sprocket and chain transmission 61 incorporates a conventional compensator 62 so that the cloth feed roll 19 will always be driven in a forward direction regardless of the direction of movement of the machine frame 11.

The top feed roll 19 could also be driven in synchronism with the main drive motor 43 by an electronic control mechanism, such as that disclosed in U.S. Pat. No. 3,684,273 of Robert W. Benson et al.

The cloth spreader element 20 fixed to the elevator carriage 21 is of conventional construction extending transversely across the front of the machine 10 to receive and spread the cloth web 18 in layers 35 as the machine 10 moves longitudinally back and forth along the cutting table 15, in a conventional manner.

The cloth spreader element 20 includes a generally vertically extending front guide wall 63 and an angular rear guide wall 64 for guiding the cloth web 18 downward through the spreader element 20. The spreader element also includes a pair of lower spreader guide bars or guide rollers 65 which alternately guide the cloth web 18 adjacent the stack of spread cloth layers 35 for smoothly spreading the top layer 34.

Mounted upon and projecting forward from the front spreader wall 63 is a transversely extending cutter track 67 slidably receiving for transverse reciprocable movement the cutter carriage 68. As disclosed, the cutter track 67 is channel-shaped having a pair of opposed transverse flanges 69 projecting into corresponding upper and lower grooves 70 in the carriage 68 for supporting the carriage 68 for transverse movement, although any other type of construction could be used for providing transverse movement for the cutter carriage 68 along the front of the machine 10.

The cutter carriage 68 supports a cutter or knife motor 71 for driving a horizontal rotary knife 72 through the transmission 73. The knife 72 is adapted to be received and cooperate with a transverse channel 74 formed at the bottom of the rear spreader wall 64. Thus, as the web 18 is fed down between the spreader walls 63 and 64 and across the cutter channel 74, the knife cuts the cloth and projects into the cutter channel 74. The edges of the cutter channel 74 hold the cloth web 18 in place by virtue of the pressure of the rotating knife operating against the other side of the web and against the cutter channel 74.

The cutter carriage 68 has a connector lug 75 fixed to a cable 76 trained about pulleys 77 and 78 at the opposite ends of the track 67. The remote pulley 78 is driven by a reversible electrical cutter transverse motor 79 through a gear transmission 179 and pulley shaft 180. Power is supplied to traverse motor 79 through branch cable 181 and power cable 81 from controls in the control panel 31. Power cable 81 is also connected through a retractible cable 82, wound upon the retractible reel 80, to the cutter knife motor 71, so that both motors 79 and 71 may be driven in synchronism, not only at the same time, but also in the same direction.

Limit switches 83, 83' and 84, 84' are provided at the opposite ends of the track 67 for engagement by the cutter carriage 68 at the respective ends of travel of the cutter carriage 68 in the track 67. The limit switches 83 and 84 are also connected to appropriate control mechanisms within the control panel 31 to stop the traverse motor 79 and the knife motor 71, when either switch 83 or 84 is actuated by the cutter carriage 68 at the corresponding end of its traverse along the track 67. Simultaneous actuation of the limit switches 83' and 84' will reverse the polarities of the motors 79 and 71 preparatory for the next traverse in the opposite direction across the front of the machine 10.

In order to control the tension in the cloth web 18 fed from the supply roll 17 to the spreader element 20, a tension control apparatus 85 is mounted in association with the cloth feed roll 19. This tension control apparatus 85 includes a wrap frame or straddle frame 86 having a pair of opposed side frame members 87 and 88 of a bent configuration, as best disclosed in FIGS. 5, 7 and 8. The same ends of the side frame members 87 and 88 are journaled upon a transverse pivot shaft 89 secured to the cloth feed side frame members 90, for pivotal movement of the wrap frame 86 between an operative position, such as that disclosed in FIGS. 5 and 7, and an inoperative position, such as that disclosed in FIG. 8.

A transverse tubular support member 91 connects the opposite side frame members 87 and 88 for reinforcement and stability, while the more remote end portions of the side frame members 87 and 88 support a pair of transverse wrap rollers or wrap bars 92 and 93.

When the wrap frame 86 is in its operative position, such as that disclosed in FIGS. 5 and 7, the cloth web 18 is trained beneath both of the wrap rollers 92 and 93 and over the cloth feed roll 19, and then down to the spreader element 20. As disclosed in FIG. 5, the wrap rollers 92 and 93 provide a wrap for the portion of the web 18 engaging the top feed roll 19 which extends in an arc of almost 180°. This wrap provides a substantial gripping and holding surface for the web 18 by the top feed roll 19 during the feeding of the web 18.

In order to swing the wrap frame 86 between its operative position as disclosed in FIG. 5, and its inoperative position as disclosed in FIG. 8, a transverse sleeve handle 95 is rotatably mounted coaxially around a transverse extension of the support rod 91 on the proximal side of the machine 10, as best disclosed in FIGS. 2 and 7.

In order to lock or latch the wrap frame 86 in its operative position, a pivotal latch member 96 is pivotally supported by a transverse pivot pin 97 upon the wrap frame member 87, and is provided at one end with a catch or hook 98 for engaging latch flange or bar 99 fixed to the machine frame 11, and is provided at its other end with a cam arm 100. A cam lug 101 projects radially from the sleeve handle 95, so that by rotation of the handle 95, the cam lug 101 will engage the cam arm 100 to pivot the catch 98 away from the latch bar 99, thereby unlatching the wrap frame 86 for free swinging movement about its pivot shaft 89. The latch member 96 is normally biased into its latching position by the spring 102, connecting the cam arm 100 to the frame member 87, while the cam lug 101 is normally biased into its inoperative position by the cam spring 103 connecting the sleeve handle 95 to the frame member 87, as best disclosed in FIG. 7.

In order to further control the cloth feed to maintain as nearly uniform tension in the cloth web 18 as possible, particularly where thin or slick fabrics are handled by the machine 10, a transversely extending pinch roller 105 is supported at the free ends of a pair of pinch roller arms 106. The lower end portions of the pinch roller arms 106 are journaled about the transverse pivotal shaft 89 of the wrap frame 86, so that the wrap frame 86 as well as the pinch roller 105 have a common pivotal axis, although such common pivotal axis is not material to the invention. The pinch roller 105 may be pivotally mounted about another axis, if desired.

The length of the pinch roller arms 106 is such such as to permit the pinch roller 105 to normally bear transversely against the front top surface of the feed roll 19 in order to pinch or squeeze the cloth web 18 against the feed roll 19, when the wrap frame 86 is in its operative position. As disclosed in FIGS. 5 and 7 particularly, when the wrap frame 86 is in its operative position, the center of gravity of the pinch roller 105 is between the top feed roll 19 and the pivotal axis of the pivot shaft 89 so that the pinch roller 105 will normally bear against the web 18 and squeeze the web against the top feed roll 19 by virtue of the weight of the pinch roller 105.

Each of the pinch roller arms 106 has a fixed outwardly projecting, transverse pin 107 extending through a corresponding arcuate slot 108 in each of the respective side frame members 87 and 88. The radius of the arcuate slot 108 is equal to the distance between the transverse pin 107 and the pivotal axis of the pivot shaft 89. In this manner, the pinch roller 105 is provided with limited pivotal motion independent of the pivotal motion of the wrap frame 86.

One advantage of the independent pivotal mounting of the pinch roller 105 is to permit the pinch roller 105 to yield to varying thicknesses of cloth webs 18, seams, and to surfaces of top feed rolls 19 which may be out-of-round or covered with uneven frictional surfaces.

Where the weight of the pinch roller 105 is not sufficient to grip the cloth web 18, because of the nature of the cloth, that is because it may be too thin or have an exceptionally slick or low-friction surface, increased pressure may be applied to the pinch roller 105 through the coil spring 110. One end of the coil spring 110 is secured to the transverse pin 107, while the spring 110 is coiled about the pivotal shaft 89, and its opposite end 111 inserted through one of the radially spaced adjustment holes 112 in the side frame member 90 (FIG. 8). Thus, by inserting the free end 111 of the coil spring 110 through the appropriate adjustment hole 112, the strength of the spring 110 may be increased or decreased, depending upon the amount of pressure to be exerted by the pinch roller 105 against the portion of the cloth web 18 carried by the top feed roll 19.

In the operative position of the wrap frame 86, disclosed in FIGS. 5 and 7, the wrap frame end members 87 and 88 rest upon the transverse member 114 supporting the edge sensor 115, so that the cloth web 18 is fed beneath the wrap roller 93, through the edge sensor 115 and then beneath the wrap roller 92 before being wrapped about the top surface of the top feed roll 19. In the operative position, the catch 98 is automatically biased into engagement with the latch bar 99 to lock the wrap frame 86 in its operative position.

When it is desired to swing the wrap frame 86 to its inoperative position as disclosed in FIG. 8, the sleeve handle 95 is turned causing the cam element 101 to bias the arm 100 in a counterclockwise direction to unlatch the catch 98. The handle 95 is then manipulated to swing the frame 86 to its inoperative position disclosed in FIG. 8. The wrap frame 86 comes to rest in its inoperative position, as disclosed in FIG. 8, by virtue of a stop element including the pair of toggle arms 117 and 118 which are pivoted to each other and also pivoted by the pin 119 to the side frame 90 and the pin 120 to the wrap frame member 87. In this position, the toggle arms 117 and 118 straddle and engage the top of the pivot shaft 89 to prevent any further pivotal or swinging movement by the frame 86 in a forward or clockwise direction (FIG. 8). In the inoperative position of the wrap frame 86, the cloth web 18 may be easily threaded over the top feed roll 19 between the top feed roll 19 and the pivot shaft 89 to descend vertically to the spreader element 20.

In order to further maintain a uniform tension in the cloth feed web 18, and particularly between the top feed roll 19 and the spreader element 20, a wind break device 122 is mounted beneath the top feed roll 19 and above the spreader element 20. This wind break device 122 includes a wind curtain 123 of flexible sheet material having a top end portion fixed to, and adapted to be wound and unwound about, a curtain roller 124. The curtain roller 124 is journaled for rotary movement between the curtain frame arms 125 which are fixed to the curtain bracket 126 mounted upon a portion of the mobile frame 11, as shown in FIGS. 5, 7 and 9.

The curtain roller 124 is provided with a spring motor, including a coil spring 127, as best disclosed in FIG. 9, one end of which is fixed to the periphery of the curtain roller 124 and the opposite end of which is coiled about and fixed to the opposite end of a stationary coaxial rod 128 fixed to the curtain frame arm 125. The motor spring 127 is biased in such a manner as to tend to wind the flexible curtain sheet 123 upon the curtain roller 124, when the roller 124 is free to rotate.

The lower end portion of the flexible curtain sheet 123 is fixed by appropriate fasteners 129 to the top portion of the rear spreader wall 64, so that the curtain 123 moves with the spreader element 20.

In the preferred form of the invention, the portion of the curtain 123 between the curtain roller 124 and the spreader element 122 is trained over a transverse guide rod 130 supported between the curtain frame arms 125, so that the transverse guide rod 130 will support the upper portion of the curtain sheet 123 very close to the bottom of the top feed roll 19 and also as far forward as possible to space the curtain 123 as close as possible (approximately ¼ inch) to the substantially vertical path of the cloth web 18 between the top feed roll 19 and the spreader element 20. By locating the guide rod 130 in this manner, the depending cloth web 18 is minimally affected by the wind generated by the relative movement of air when the frame 11 is moving longitudinally, and particularly longitudinally at high speed, over the cutting table 15.

When the frame is moving rearward, the curtain 123 completely shields the depending web 18 from the wind. When the frame is moving forward, the closely spaced curtain 123 limits the rearward movement of the web 18. Although the curtain 123 is spaced very close to the vertical web path, it must not be so close as to frictionally engage the web 18 during normal feeding, and thereby produce a drag on the web feed.

Moreover, the particular location of the guide rod 130 as high as possible and close to the top feed roll 19 prevents the cloth web 18 from being pulled beneath, and wrapped around the bottom of, the top feed roll 19.

The top feed roll 19 may be provided with an adjustable brake device 132 of conventional construction, in order to prevent free wheeling of the top feed roll 19.

Other types of sensor devices could be employed instead of the sensor device 33, provided that they are highly sensitive to small variations in the height of the cloth layers.

Figure 10:
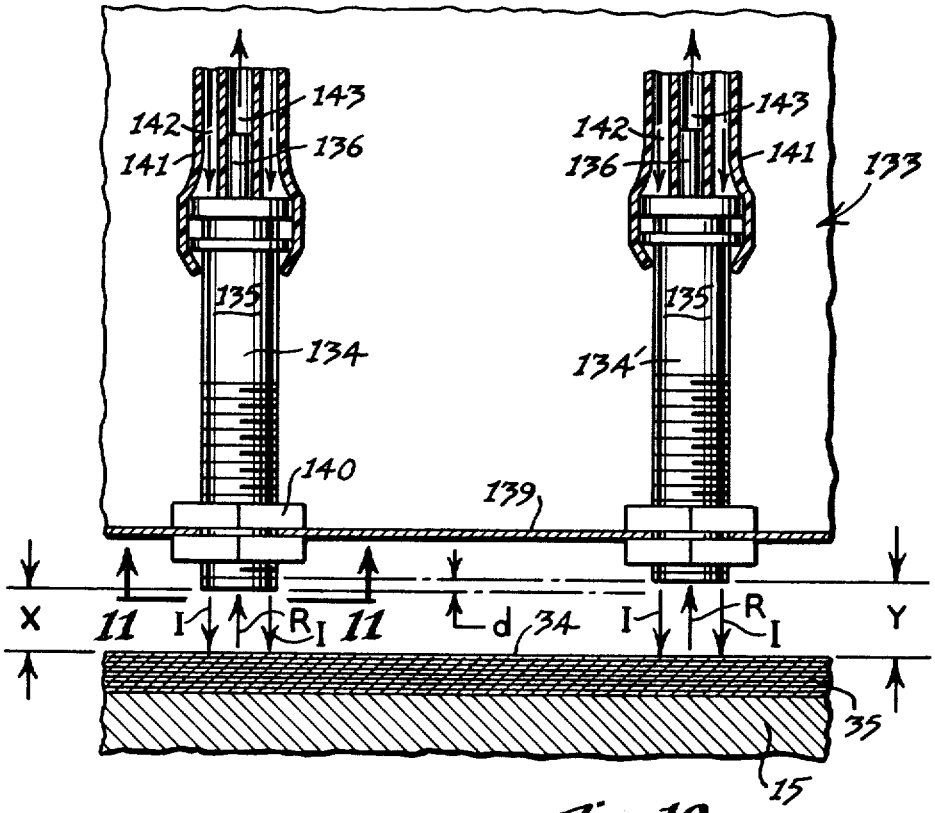
FIG. 10 is an enlarged, fragmentary front elevational view, partially in section, of a modified sensor element in operative position relative to the cloth layers.
Figure 11:
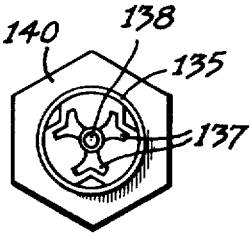
FIG. 11 is an enlarged bottom view of one of the sensor elements taken along the line 11—11 of FIG. 10.
Figure 12:
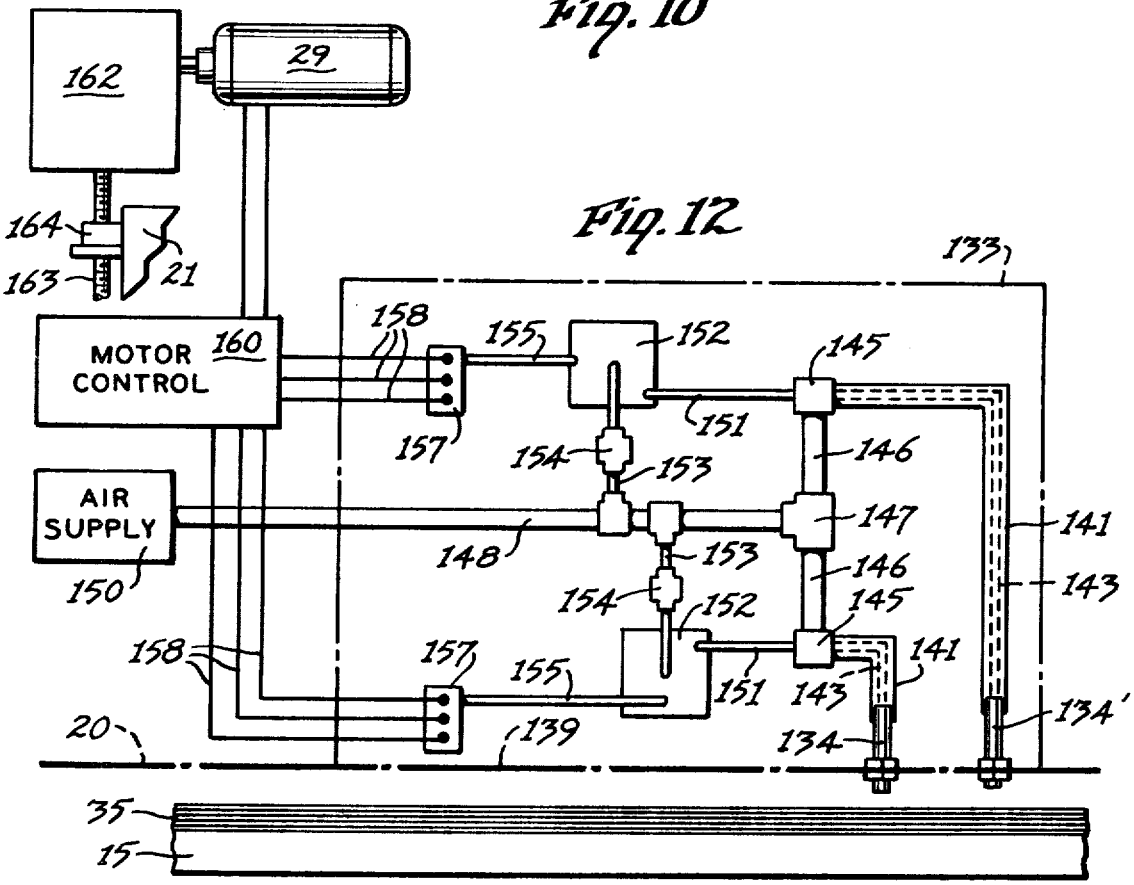
FIG. 12 is a schematic circuit diagram of the controls for the modified sensor.

As best disclosed in FIGS. 10, 11, and 12, a modified pneumatic sensor device 133 may be mounted on the mobile frame 11 adjacent the cloth layers 35, instead of the sensor device 33.

The sensor device 133 includes first and second downwardly projecting sensor elements 134 and 134' of the pneumatic type.

Each of the sensor elements 134 and 134' includes a pair of concentric tubes, including an outer tube 135 and an inner tube 136, defining outer discharge ports 137 and a central inlet chamber or port 138.

Each of the nozzles of pneumatic sensing elements 134 and 134' are secured through the bottom wall 139 of the housing for the device 133 by nuts 140 (FIGS. 10 and 11).

Each of the nozzles 134 and 134' is connected by a flexible hose 141 having an annular outer discharge chamber 142 in fluid communication with the discharge ports 137 and a central tubular inlet conduit 143 in fluid communication with the inlet port 138.

Each hose 141 is connected to a coupling 145 in such a manner that each annular chamber 142 is connected to a branch supply line 146, which in turn is connected through T-coupling 147 to the main air supply line 148. Compressed air is supplied to the main air line 148 from the air supply device 150, such as a compressor.

The inlet chamber 143 of each hose 141 is connected to a smaller air input line 151 to corresponding air amplifier devices 152. When the air pressure in an inlet line 151 is great enough, a diaphragm within the air amplifier 152 is moved to open a valve permitting a large charge of air to be introduced from the input supply line 153 and restrictor 154 for discharge through the air outlet line 155 to the electro-pneumatic switch device 157. The amplified air signal discharged through each of the outlet lines 155 produces a corresponding electrical signal in the corresponding electro-pneumatic switch device 157, which is transmitted through the lines 158 to the motor control device 160. Actuation of the motor control device 160 from a signal produced by the air sensor element 134 energizes electrical motor 29 in a direction to cause the elevator carriage 21 to move downward until the sensor 134 is at a predetermined spacing X from the top cloth layer 34, in which position the signal produced by the reflected air ray or stream R opens the switch 157 to stop the motor 29.

The air sensor element 134' operates in the same manner as the air sensor element 134, except that its actuation operates to reverse the direction of the motor 29 and to cause the elevator carriage 21 to rise until the predetermined uniform spacing Y between the sensor element 134' and the top cloth layer 34 is attained.

It will be noted in FIG. 10, that the spacings X and Y between the bottoms of the respective sensor elements 134 and 134' and the top cloth layer are of slightly different heights and differ by the increment d.

In order to maintain the spreader element 20 at a substantially uniform distance above the accumulated cloth layers 35, the sensor device 133 is activated by discharging air from the air supply 150 through the main line 148 and branch lines 146, hoses 141, nozzles 134 and 134', and the discharge ports 137. These incident rays or streams of air I impinge upon the top cloth layer 34, which reflects the air streams in the form of reflected air streams or rays R toward the inlet ports 138. The reflected rays R received by the sensor elements 134 and 134' are transmitted through the inlet tubes 136 and air chambers 143 to their respective amplifiers 152.

In initially setting the spreader element 20 to its lowermost position before the first layer of cloth is spread, the sensor 134 will normally be at a height greater than the spacing X. The absence of an electrical signal resulting from a weak or non-existent reflected ray R in the amplifier 152 will condition the switch device 157 to energize the motor control 160 and cause the electrical motor 29 to be actuated to drive the elevator carriage 21 downward. As soon as the tip of the nozzle 134 attains a position spaced from the top surface of the cutting table 15, by the height X, an electrical signal generated by the increase in air pressure created by the reflected air ray R received in the sensor 134 will turn off the switch 157 and stop the motor 29.

After the spreading begins, the cloth layers 35 begin to accumulate until the distance between the top layer 34 and the tip of the nozzle 134' is equal to or slightly less than Y. The increased air pressure created by the air ray R received in the sensor nozzle 134' will actuate the amplifier 152 to close the switch device 157 energizing the motor control 160 to reverse the direction of the motor 29 causing the elevator carriage 21 to rise. As soon as the space Y has been attained or exceeded the sensor 134 will be actuated to slightly lower the elevator carriage 21 until the distance X is attained.

As the spreading continues and the cloth layers accumulate in height, the above sensing process will be repeated.

The spacing d between the tips of nozzles 134 and 134' is provided to permit a certain null area where a layer or two of cloth, 34 and 35, can be accumulated without activating either of the sensor switches 157.

Examples of pneumatic sensor devices 134 and 134' are the PS-307 sensor of AIRT CO. of Troy, Mich. The electro-pneumatic switches 157 may be SF100 switches of the AIRT CO.; while air amplifiers 152 may be JAF161 amplifiers of the same company.

As disclosed in FIG. 12, the elevator motor 29 may drive a vertical screw 163 through a speed-reduction transmission 162. The screw 163 is threadedly coupled to a vertically traveling nut 164 fixed to the elevator carriage 21. Thus, energization of the electric elevator motor 29 causes the elevator carriage to move gradually vertically in the direction dictated by the drive direction of the motor, and continually for the precise duration of the energization of the motor. The continual engagement of the threads of screw 163 and the internal threads of traveling nut 164 permits the continual slow movement of the elevator carriage, which starts and stops immediately with the starting and stopping of the elevator motor 29. Moreover, the speed-reduction transmission permits a continual gradual movement of the elevator carriage 21.

Thus, all of the above mechanical factors, as well as the sensitivity of the sensor elements 134 and 134', permit a detection of a cloth layer height change of approximately one or two layer thicknesses, to continually maintain a substantially uniform distance between the spreader element 20 and the top cloth layer 34.

It will be understood that other types of sensors can be used which will emanate incident rays I of various forms of energy to produce reflected rays R of strengths or values varying with the distance of the sensor device from the top cloth layer 34. For example, instead of pneumatic sensors 134 and 134', a light source and a photoelectric cell could be used to produce incident and reflected light rays. Sonar sensing devices could be used, as well as other types of devices which propagate other types of energy waves or rays.

In the operation of the cloth spreading machine 10, a cloth supply roll 17 is loaded upon the carriage 16. The cloth web 18 is unwound from the roll 17 and threaded through the edge sensor 115 and over the top of the feed roll 19 between the feed roll and the pivot shaft 89, while the wrap frame 86 is in its inoperative position as disclosed in FIG. 8. The cloth web 18 is then fed between the front and rear walls 63 and 64 of the spreader element 20 and between the spreader bars 65 toward the cutting table 15.

The operator then grasps the sleeve handle 95 to swing the wrap frame 86 over the top feed roll 19 into its operative position disclosed in FIGS. 5 and 7, where the wrap frame 86 will be automatically latched in position by the automatic latch 96 engaging the latch bar 99.

As the wrap frame 86 is swung into its operative position, the pinch roller 105 will also swing from its inoperative position in FIG. 8 to its operative position in FIGS. 5 and 7. Because of the independent pivotal capability of the pinch roller 105 and the weight of the pinch roller 105 or the tension in the coil spring 110, the pinch roller 105 will engage the cloth web against the feed roll 19 before the wrap rollers 92 and 93 engage the portion of the cloth web 18 straddling the edge sensor 115. Moreover, the prior engagement of the pinch roller 105 against the web 18 will hold the web against the top feed roll 19 as the web is wrapped around and over the top feed roll by the wrap rollers 92 and 93, to effect a smooth, taut, and unwrinkled lay of the cloth web against the top feed roll 19.

In the initial position, the cutter carriage 68 will lie at one end of the track 67, such as the proximal end disclosed in FIG. 2.

Assuming that the machine 10 is started somewhere in the middle of the cutting table 15 so that the machine 10 will be moving in high speed forward in the direction of the arrow 48 as disclosed in FIG. 1, then the top feed roll 19 will also be driven at a forward speed commensurate with the longitudinal speed of the frame 11, so that the cloth web 18 will be fed at the same rate as the movement of the frame, and therefore the cloth will be laid upon the cutting table under relatively uniform tension.

As the machine 10 moves in high speed forward, the relative movement of the air in the machine, which creates a longitudinal wind effect, will be blocked by the cloth web 18 pressed against the wind curtain 123, which is at least as wide as the width of the cloth web 18, and extends substantially the full height between the rear spreader wall 64 and the top feed roll 19, to maintain a substantially undeviating uniform path of the cloth web 18 between the top feed roll 19 and the spreader element 20.

As the machine frame 11 is moving, the sensor device 33 is continually monitoring the vertical distance between the top cloth layer 34 and the spreader element 20. Thus, as the height of the cloth layers 35 increases, the elevator carriage 21, spreader element 20, and knife carriage 68 will be commensurately elevated, in order to maintain a uniform distance between the top of the cloth layers 34 and the spreader element 20.

Moreover, as the elevator carriage 21 is raised, the curtain 123 will also be commensurately raised to maintain its continuous, substantially vertical, taut position, since any excess slack developed in the curtain 123 will be immediately wound about the curtain roller 124 automatically.

As the machine 10 approaches the end of its forward travel, its low speed switch arm 46 will engage the trip member 47 to actuate the controls within the control panel 31 to immediately reduce the speed of the frame 11 to a predetermined low speed, and the speed of the cloth feed 19 will be commensurately reduced. The machine 10 then proceeds in low speed toward the end of its travel until the plunger rod 54 engages the stop 58. As the plunger rod 54 recedes relatively into the switch box 50, the switch lug 55 will engage and actuate the first microswitch 51, which actuates the controls to energize the cutter traverse motor 79 and simultaneously the knife motor 71, and also simultaneously de-energize the main drive motor 43 to stop the machine 10 in a stationary cutting position, such as that disclosed in FIG. 3, in which the transverse cutting path or line across the web 18 is spaced above and spaced longitudinally behind the vertical plane 170. This stationary cutting position is precisely located relative to the vertical plane 170 so that when the web 18 is cut by the rotary knife 72, the free cut end 171 of the top layer 34 will fall freely forward into the same vertical plane 170 as the previously cut ends of the cloth layers 35 (FIGS. 3 and 4).

After the knife carriage 68 travels transversely aross the machine to complete the cut of the end 171, the carriage 68 energizes the limit switch 84, which immediately stops or de-energizes the traverse motor 79 and the knife motor 71. Moreover, the limit switch 84 will re-energize the main drive motor 43 to resume the movement of the machine frame 11 in the same forward direction at low speed toward the end of its travel. Simultaneously, the cloth feed roll 19 will be driven to feed the cloth downward until the lug 55 in the switch box 50 engages and actuates the microswitch 52, which will immediately reverse the direction of the main drive motor 43.

At the reverse station, disclosed in FIG. 4, the free cut end 172 of the cloth web 18 has been fed downwardly so that its lower cut end 172 lies proximate to or upon the cut end 171 in substantially the same vertical plane 170. Thus, the end 172 is vertically aligned with the end 171 in the plane 170 when the frame 11 is reversed and begins its rearward movement toward the opposite end of the table. The web 18 will, of course, be continuously fed along the previous top layer 34 to spread the next top layer in the reverse direction.

As the machine moves in reverse direction away from the stop member 58, the trip lug 56 will actuate the microswitch 53 to change the speed of the machine from low speed to its predetermined high speed. The machine then spreads in the reverse direction at high speed until it approaches the opposite end of the table where the speed change and cutting procedure will be repeated.

The above described operation is for a face-to-face, face-up, or face-down mode.

When the machine 10 is spreading in a face-to-face mode, the cutter motors 71 and 79 are preferably actuated near each end of travel of the machine 10, for better control of the cloth layer ends without a catcher mechanism. If the cloth layers are spread continually by the machine 10 in a face-to-face mode, without catcher mechanisms, the uncut, folded layer ends tend to from uncontrolled loops or bulges of varying height which create differences in tension and/or slack between the various stacked layers 35, and therefore differences in the length of the layers as well as vertically disaligned ends of the layers.

In the face-up or face-down mode, the cloth web 18 is cut by the blade 72 only adjacent one end of the travel. After the cut is completed in the stationary position of FIG. 3, the cut end 171 drops as previously described, the machine 10 resumes its slow-speed movement to the terminal position of FIG. 4, where the fed end 172 of the web 18 lies upon the previously cut end 171. The movement of the machine 10 is then reversed, the cloth feed stopped, and the machine "dead-heads" to the opposite end of its travel, reverses and resumes spreading.

The electronic circuitry for the face-to-face or face-up and face-down operating mode, can be similar to those disclosed in U.S. Pat. No. 3,663,006 of Robert L. Benson, et al. for ELECTRICALLY CONTROLLED CLOTH SPREADING MACHINE.

It is significant that the cloth spreading machine 10 as above described, provides an accurately controlled cloth web cutting and spreading operation which can align the cut ends of the cloth so precisely that no catcher mechanism is required. The elimination of a catcher mechanism simplifies the spreading operation as well as the cost of the equipment required for spreading the cloth layers 35. Moreover, the cloth spreading machine 10 requires less installation and maintenance time because of the elimination of the complex catcher mechanism which must cooperate with the spreader element in order to fold and remove the ends of the cloth at each end of the spreading operation.

The accuracy of the machine 10 is enhanced by the sensitive sensor devices 33 and 133 to maintain a continually monitored uniform height or difference between the top cloth layer 34 and the spreader element 20.

The control of the tension in the cloth web 18 fed to the spreader element 20 is materially improved by the independently pivotal pinch roller 105 mounted on the spreader frame 86.

The tension in the cloth is also improved by the structure of the flexible wind break device 122 which continually moves with the spreader element 20 to remain taut and to completely block the air space between the top feed roll 19 and the spreader element 20, even as the spreader element is being raised or lowered.

What is claimed is:

1. In a cloth spreading machine having cloth supply means and a spreader frame having longitudinal and transverse dimensions movable longitudinally relative to a cloth supporting surface for feeding a cloth from said supply means and for spreading the cloth longitudinally in layers upon said supporting surface, apparatus for forming substantially aligned cut ends of the cloth layers subsantially in a transverse vertical plane, without a catcher mechanism, comprising:

(a) a spreader element for receiving a web of cloth from the cloth supply means and for spreading layers of cloth including a top cloth layer, upon the supporting surface, (b) a top feed roll on the spreader frame and spaced above said spreader element for carrying a web of cloth from the cloth supply means to said spreader element, (c) elevator means mounting said spreader element transversely of said spreader frame for vertical reciprocable movement, (d) elevator motor means for positively driving said elevator means, when energized, (e) cloth layer monitoring means comprising a sensor device movable with said spreader element and adapted to detect the proximity of the top cloth layer to said sensor device, and control means coupling said sensor device and said elevator motor means, (f) said control means being responsive to a signal from said sensor device to energize said elevator motor means to drive said elevator means to maintain a substantially uniform height between said spreader element and said top layer of cloth, (g) a wind curtain of flexible sheet material having an upper end portion and a lower end portion, (h) a curtain roller attached to said upper end portion, said wind curtain being wound about said curtain roller, (i) means journaling said curtain roller transversely of the spreader frame above said spreader element, (j) means attaching the lower end portion of said curtain to said spreader element for movement therewith, (k) spring motor means coupled to said curtain roller and biased to wind up said curtain roller, (l) driven cutter means on said spreader element for transversely cutting said web of cloth received in said spreader element, and (m) positioning control means for actuating said driven cutter means to cut said web to form a free cut end of said top layer, while said spreader frame is at a predetermined stationary position relative to said cloth supporting surface, such that after said web is cut, said free cut end will fall into a transverse vertical plane substantially containing corresponding free cut ends of the cloth layers on said supporting surface.

2. The invention according to claim 1 in which said curtain roller jouralling means mounts said curtain roller below said top feed roll, so that said curtain extends substantially vertically and has a transverse span at least as great as the width of the cloth web moving from said top feed roll to said spreader element.

3. The invention according to claim 2 further comprising a curtain guide bar and means mounting said curtain guide bar in transverse position spaced proximate to said top feed roll and proximate to the path of the cloth web portion from said top feed roll to said spreader element, said curtain guide bar engaging said curtain between said curtain roller and said spreader element.

4. In a cloth spreading machine having cloth supply means and a spreader frame including a vertically movable spreader element, said spreader frame having longitudinal and transverse dimensions and being movable longitudinally forwardly and rearwardly over a cloth supporting surface for carrying a cloth from the cloth supply means to said spreader element for spreading the cloth longitudinally in layers upon the supporting surface, a wind break device comprising:

(a) a wind curtain of flexible sheet material having an upper end portion, and a lower end portion, (b) a curtain roller attached to said upper end portion for winding and unwinding said curtain, (c) means mounting said curtain roller for rotary movement transversely on said spreader frame above said spreader element, (d) means biasing the rotary movement of said curtain roller to wind said curtain about said curtain roller, and (e) means attaching the lower end portion of said curtain to said spreader element for vertical movement therewith.

5. The invention according to claim 4 further comprising a top feed roll transversely mounted on said spreader frame about said spreader element, an elongated guide member transversely mounted beneath and proximate to the front portion of said top feed roll, to guide said curtain between said curtain roller and said spreader element, said guide member being substantially vertically spaced above said spreader element to dispose said curtain closely adjacent the path of the cloth web moving between said top feed roll and said spreader element, and to prevent any slack portion of said web from wrapping beneath said top feed roll.

* * * * *